US005217192A

United States Patent [19]

Oktayuren

[11] Patent Number: 5,217,192

[45] Date of Patent: Jun. 8, 1993

[54] BOTTLE HOLDER FOR INFANT BABY BOTTLES

[76] Inventor: Sharon L. Oktayuren, HCR 3, Box 310, Rochelle, Va. 22738

[21] Appl. No.: 753,869

[22] Filed: Sep. 3, 1991

[51] Int. Cl.[5] ..... A45C 9/00

[52] U.S. Cl. ..... 248/102; 248/105; 446/73

[58] Field of Search ..... 248/102–106; 446/72, 73, 297, 303

[56] References Cited

U.S. PATENT DOCUMENTS

| | | | |
|---|---|---|---|
| 1,336,898 | 4/1920 | Flynn | 248/202 X |
| 2,711,052 | 6/1955 | Brayford | 248/102 X |
| 4,950,196 | 8/1990 | Fortune et al. | 446/73 |

FOREIGN PATENT DOCUMENTS

| | | | |
|---|---|---|---|
| 583408 | 12/1946 | United Kingdom | 248/102 |
| 680161 | 10/1952 | United Kingdom | 446/303 |

OTHER PUBLICATIONS

Bunnykin or Pussykin Bottle Holders, The Washington Daily News, Oct. 1, 1951.

*Primary Examiner*—Alvin C. Chin-Shue
*Attorney, Agent, or Firm*—Frank J. Kowalski

[57] ABSTRACT

A baby bottle holder is designed to hold a baby bottle for an infant who cannot hold the bottle himself or herself. The design is such that the end which corresponds to the nipple end of the bottle is narrower than the end which corresponds to bottom of the bottle. In addition, the holder is constructed and balanced in such a manner that the holder is freestanding whether or not a bottle is attached. The bottle is firmly grasped but is slidably mounted so that it may be repositioned for balance. Three members of the bottle holder are joined together so that the bottle position may be changed depending on the position of the baby.

15 Claims, 2 Drawing Sheets

BOTTLE HOLDER FOR INFANT BABY BOTTLES

BACKGROUND OF THE INVENTION

Field of the Invention

The present invention pertains to infant feeding systems and more particularly to infant feeding systems for feeding infants liquids without the necessity of constantly holding the bottle for the infant.

Related Prior Art

Prior art has demonstrated many systems for positioning baby bottles such that the bottle filled with liquid may be placed in near the infant and the mother or person attending the infant may have both their hands free to be performing other tasks while the infant is being fed. However, these systems have demonstrated several flaws which have rendered them either useless in many situations and absolutely dangerous in other situations.

Examples of the prior art bottle holders are as listed below. It is to be noted that the prior art is extensive in this area and that the following patents are merely representative.

U.S. Pat. No. 4,809,938, "Baby Bottle Holder", issued to Sara J. Skinner et al., describes an envelope having a strap upon its upper side in which a baby bottle is retained for nursing. The envelope simulates the characteristics of an animated figure. The front side of the envelope simulates the characteristics of a face for the figure. The strap portion constitutes the nose of the figure.

U.S. Pat. No. 4,895,327, "Infant Feeding Aid Apparatus and Method", issued to Shirley L. Malone et al., describes an apparatus which aids in the feeding of an infant while the infant is placed face-up on a substantially planar feeding surface with its torso in a substantially prone position. The feeding apparatus has a center section for placement across the front of the torso of the infant during feeding. A first anchor section having two ends is coupled to the center section at one end and weighted at the opposite end for placement along on side of the torso of the infant during feeding. A second anchor section having two ends is coupled at one end to the center section opposite from and axially aligned with the first anchor section. It is weighted at the opposite end for placement along the side of the torso of the infant during feeding. The first and second anchor sections cooperate to anchor the apparatus to the feeding surface, to secure the center section in position across the front of the torso of the infant, and to minimize side-to-side movement of the apparatus, while minimizing the amount of weight placed on the infant's torso. The bottle is secured to the center section in a position aligned with the infant's torso, within the infant's reach.

Prior art has also provided a plurality of configurations by which the general design of the letters patents may be implemented. Unfortunately, these designs incorporate the flaws of the letters patents insofar as they lack versatility and present the same problem in being potentially dangerous. Examples of design patents that are representative of the state of the art are as follows.

Examples of designs for bottle holders that are similar in construction to the foregoing letters patents date back to as far back as 1925. Representative patents are Design No. 67,140, "Nursing Bottle Cover", issued to J.G. DuPont: Design No. 141,700, "Nursery Bottle Holder", issued to B. D. Raport: and Design No. 153,937, "Baby's Bottle Holder or The Like", issued to M. Graboi. These designs all illustrate a bottle holder that may only be used in one position and only is stable when the bottle is laying on its side.

An example of a bottle holder having a single stable position and does not present a probable danger to the infant is Design Patent No. 160,192, "Infant's Bottleholder or Similar Article", issued to R. Miller.

More recent designs that have incorporated what appears to be a freestanding position but still are capable of only one feeding position are Design Patent No. 314,432, "Baby Bottle Holder", issued to E. M. Butterfield and Design Patent No. 305,346, "Combined Elephant Toy Figure and Bottle Holder", issued to John R. Roberts.

SUMMARY OF THE INVENTION

The present invention solves the many problems of the prior art bottle holders by providing a new design that allows itself to be positioned securely to place the nipple end of the bottle near the infants mouth to permit drinking while remaining slightly unstable to permit knocking the bottle away with any definite motion of the infant to prevent accidental injury. The present invention includes a baby bottle holder which is designed to hold a baby bottle for an infant who cannot hold the bottle himself or herself. The design is such that the end which corresponds to the nipple end of the bottle is narrower than the end which corresponds to bottom of the bottle. In addition, the bottle holder of the present invention is constructed and balanced in such a manner that the holder is freestanding whether or not a bottle is attached The bottle is firmly grasped but is slidably mounted so that it may be repositioned for balance. Three members positioned at the nipple end of the bottle holder of the present invention are joined together so that the bottle position may be changed depending on the position of the baby.

DESCRIPTION OF THE PREFERRED EMBODIMENT

Prior art has disclosed many configurations of infant feeding apparatus which attempt to provide a feeding system while allowing the mother to have both hands free to accomplish other tasks while feeding her infant.

Figure 1:
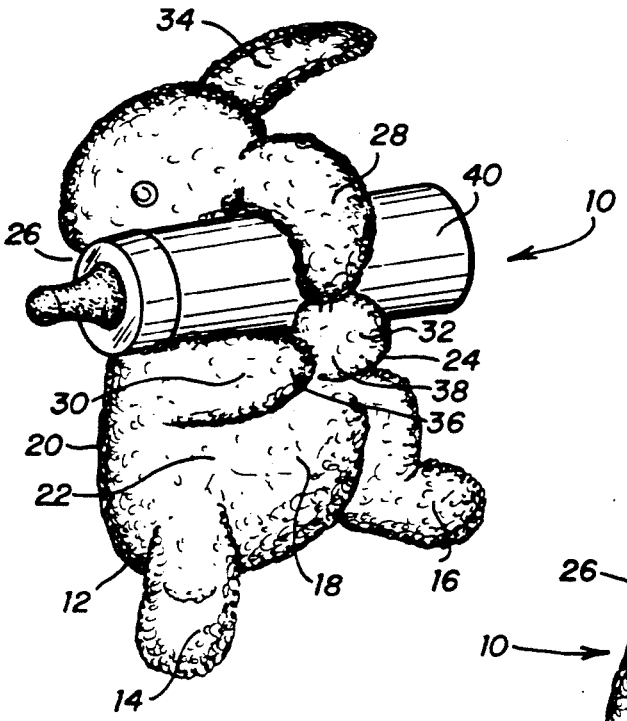
FIG. 1 is a front isometric view of a baby bottle holder in an upright position illustrating a first arrangement for the configuration a feeding bottle.

Referring now to FIG. 1, an isometric view of the preferred embodiment of the present invention is illustrated. In this embodiment, a bottle holder 10 is illustrated in the form of a woodland creature, such as a bunny. The salient features of this embodiment are that the bottle holder has a broad base comprising a bottom 12 with legs 14 and 16 extending out in front of the center of gravity. A front 18 along with a back 20 and sides 22 and 24 connect the base 12 with a top end 26 which takes the form of the bunny's head. In this manner feeding bottles will tilt toward the top end of the bottle holder, allowing gravity to aid in the feeding operation.

In the preferred embodiment, a left ear 28 is connected to arms 30 and 32 while right ear 34 is merely attached to narrow end 26. Left ear 28 is attached to the head and also attached to the meeting point of arms 30 and 32. Arms 30 and 32 are attached to the central part of sides 22 and 24 respectively. Arms 30 and 32 ar also attached together at their paws 36 and 38 respectively.

Figure 6:
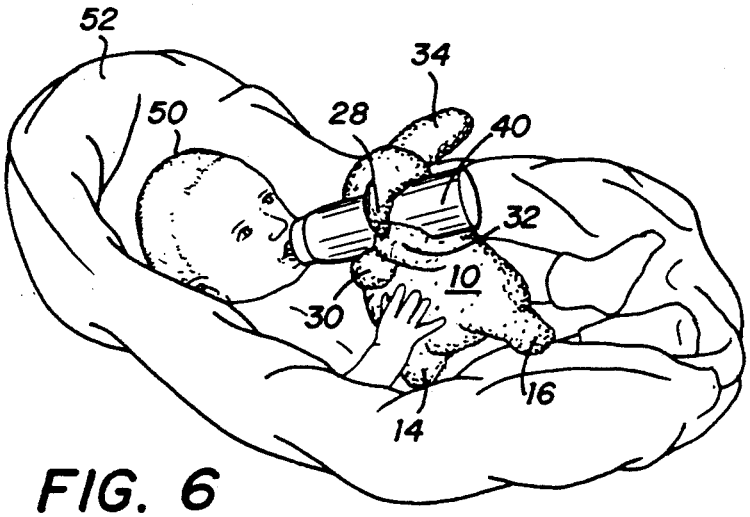
FIG. 6 is an isometric view illustrating an infant using a bottle holder with the configuration of a feeding bottle illustrated in FIG. 1.

In the embodiment illustrated in FIG. 1, feeding bottle 40 is placed between ear 28 and arms 30 and 32 in such a manner that bottle 40 rests on the top of arms 30 and 32. FIG. 6 is an illustration of the use of the arrangement in FIG. 1 for feeding bottle 40.

Figure 2:
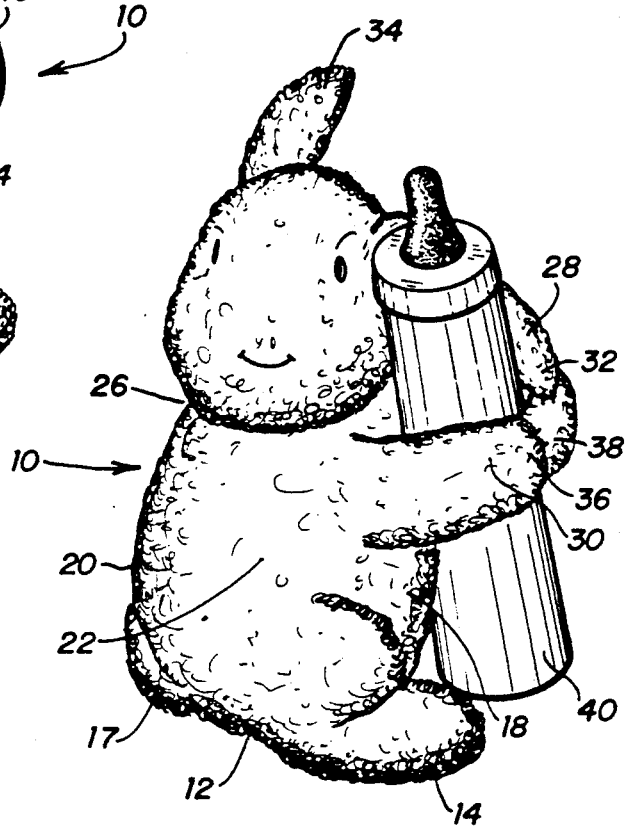
FIG. 2 is a side isometric view of a baby bottle holder in an upright position illustrating a second arrangement for the configuration of a feeding bottle.

Referring now to FIG. 2, bottle holder 10 is illustrated a having feeding bottle 40 arranged vertically while bottle holder 10 is in an erect position. In this instance, feeding bottle 40 is between arm 30 and 32 in such a position that the main portion of the bottle rests up against the bunny's stomach. Ear 28 positions bottle 40 such that it tilts slightly to the right of the bunny.

Figure 3:
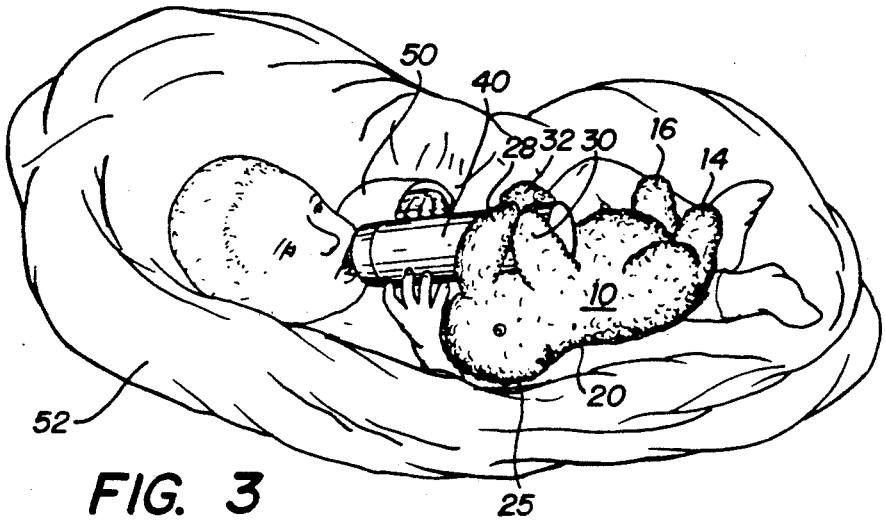
FIG. 3 is an isometric view of a baby bottle holder in use with an infant illustrating a third arrangement for the configuration of a feeding bottle.

In alternate configurations, such as that illustrated in FIG. 3, feeding bottle 40 may be positioned such that it is placed through arms 30 and 32 with ear 28 placed on the same side of the bottle as arm 30. In this position, feeding bottle 40 will be tilted slightly to the bunny's left.

Bottle holder 10 is configured in such a manner that base 12 is much wider than top end 26 and is completely free-standing. In the preferred embodiment, legs 14 and 16 and tail 17 are extended out and away from the center of gravity of bottle holder 10 in order to provide a more stable base. Front 18, back 20 and sides 22 and 24 grow closer together or reduce in size as they extend from base 12 to front end 26. This feature also adds to the stability in a free-standing position of bottle holder 10.

As illustrated in FIGS. 3–6, bottle holder 10 may be arranged in a plurality of positions to provide any one of a variety of stable feeding arrangements.

In FIG. 3, infant 50 is in a carrier 52 and illustrated with feeding bottle 40 being gripped at its base by arms 30 and 32 while ear 28 is on the same side of bottle 40 as arm 30. It is to be noted that back 20 of bottle holder 10 has a curved area between base 12 and top end 26 to mate and rest on the curved area formed between infant 50 and carrier 52.

Figure 4:
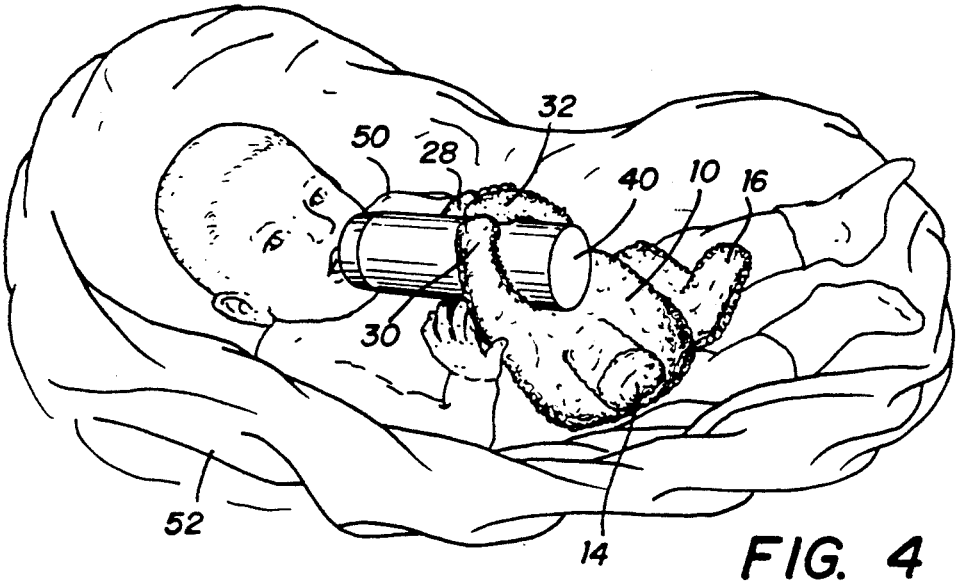
FIG. 4 is an isometric view of a baby bottle holder in use with an infant illustrating a third arrangement for the configuration of a feeding bottle.

FIG. 4 illustrates another possible arrangement for bottle holder 10. In this arrangement, bottle holder 10 has feeding bottle 40 positioned such that ear 28 is on the same side of bottle 40 as arm 32. Again, bottle holder 10 is positioned such that it rests in a crevice formed between infant 50 and carrier 52.

Figure 5:
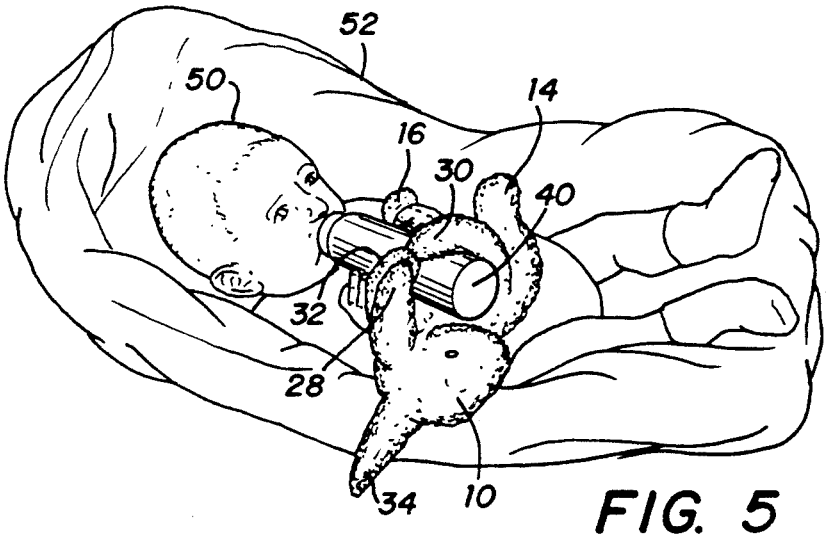
FIG. 5 is an isometric view of a baby bottle holder in use with an infant illustrating a third arrangement for the configuration of a feeding bottle.

Similarly, FIGS. 5 and 6 illustrate bottle holder 10 in two additional possible configurations, depending on the position of infant 50 in carrier 52.

Due to the design construction of bottle holder 10, it may be positioned in any one of a plurality of configurations, whether an infant is in a carrier, or not. For example, the bottle holder of the present invention may be used cribs, car seats, strollers, etc. This is primarily due to its balance, permitting the bottle holder to be free-standing in an upright position while being designed to be arranged in a variety of positions with little or no support.

Alternate arrangements may be made with bottle holder 10 to add features which may also be desirable. For example, base 12 may have added weight, provided either in a portion sewn to the bottom of base 12, or added to legs 14 and 16 along with tail 17. Additional features may be added, such as a music box may be inserted inside bottle holder 10 slightly above base 12.

The preferred embodiment is illustrated as being a bunny for simplicity of design. The preferred embodiment is also illustrated as being made of a soft, plush material having a light-weight stuffing. The arrangement of the structure of the bottle holder, that is, as having a base that extends beyond the center of gravity with or without a feeding bottle in position, permits stuffing the plush stuffed animal with a light-weight filling. Because bottle holder 10 is light-weight, an infant may readily pull away from the bottle or knock the bottle away when it no longer wants to drink.

In this regard, the present invention has a distinct advantage over prior art bottle holders, which in general were weighted to hold them in position, simply because they had no versatility and variety of positions in which they could be arranged. Thus, the present invention provides an extremely safe feeding system for an infant by providing a bottle holder that is capable of moving with the motion of the infant while not being overly restrictive.

Although the preferred embodiment has been illustrated as being a bunny, any similar, plush creature will do. For example, a donkey, also having long ears could provide a similar arrangement and construction. In the alternative, in the arrangement with either natural woodland creatures, such as a racoon or skunk, in which the tail is used in place of one of the ears, or a fanciful creature, that has no relation to reality, may also be used.

While there has been illustrated and described a particular embodiment of the present invention, it will be appreciated that numerous changes and modifications will occur to those skilled in the art, and it is intended in the appended claims to cover all those changes and modifications which fall within the true spirit and scope of the present invention.

What is claimed is:

1. An apparatus holding a baby bottle comprising:

a bottle having a nipple end and a bottom end, said bottle for feeding an infant;

support member having a top end and a base extending beyond its center of gravity, said base being larger than said top end, said support member having two positions, a first freestanding upright position resting on said base in which said bottle is upright with said nipple end facing upward and an inclined position in which said nipple end is directed toward the infant;

a first member attached at a first location below said top end of said support member;

a second member having a first end attached below said top end of said support member at a second location and a second end attached to said first member at a predetermined location to form a loop approximately the size of the diameter of said bottle; and a third member having a first end attached to said top end of said support member and a second end attached to said first member at said predetermined location to form two loops, a loop with each of said first member and said second member such that each said loop is approximately the size of the diameter of said bottle.

2. The apparatus according to claim 1 wherein said support structure includes means for providing music.

3. The apparatus according to claim 1 wherein said support structure is configured in the shape of a woodland character.

4. The apparatus according to claim 3 wherein said first member and said second member are arms of said woodland creature.

5. The apparatus according to claim 3 wherein said third member is an ear of said woodland creature.

6. The apparatus according to claim 3 wherein said third member is a tail of said woodland creature.

7. A device for feeding an infant comprising:

an infant feeding bottle having a nipple end and a base end with a support structure for receiving said feeding bottle having a base arranged to position said support structure with said feeding bottle in an upright position and a top end composed of a top and sides defining said top, said top end having three looped members configured to accept and slideably hold said infant feeding bottle in one of more than two positions, each of said three looped members having two ends, a first end attached to said support member at said top end and a second end wherein said second ends are joined together, said top end arranged to provide an inclined surface upon which said feeding bottle is to rest with said nipple end of said feeding bottle being the lowest point of said infant feeding bottle when said support structure is laid on one of said sides.

8. The device for feeding an infant according to claim 7 wherein said support structure includes means for providing music.

9. The device for feeding an infant according to claim 7 wherein said support structure is configured in the shape of a woodland character.

10. The device for feeding an infant according to claim 9 wherein two of said looped members are arms of said woodland creature.

11. The device for feeding an infant according to claim 9 wherein a third looped member is an ear of said woodland creature.

12. The device for feeding an infant according to claim 9 wherein a third looped member is a tail of said woodland creature.

13. A method for providing a feeding system for an infant comprising the steps of:

inserting a feeding bottle having a nipple at one end into a bottle holder, said bottle holder having a base end larger than its top end with inclined sides and having three looped members;

placing two of said three looped members on one side of said feeding bottle and a third looped member on another side of said feeding bottle while said bottle holder is resting on its base end to arrange said feeding bottle in an upright position; and positioning said bottle holder on said inclined sides near the infant such that the nipple of the feeding bottle is inserted in the mouth of the infant.

14. The method according to claim 13 wherein said placing step includes the step of:

configuring the bottle such that a lengthwise centerline of said bottle is approximately parallel to a lengthwise centerline of said bottle holder.

15. The method according to claim 13 wherein said placing step includes the step of:

configuring the bottle such that a lengthwise centerline of said bottle is approximately perpendicular to a lengthwise centerline of said bottle holder.

* * * * *